US005810495A

United States Patent [19]

McAuley

[11] Patent Number: 5,810,495

[45] Date of Patent: Sep. 22, 1998

[54] NARROW LINE APPLICATOR

[76] Inventor: Brian McAuley, 896 S. Columbus Ave., Mt. Vernon, N.Y. 10550

[21] Appl. No.: 938,478

[22] Filed: Sep. 30, 1997

Related U.S. Application Data

[63] Continuation of Ser. No. 586,992, Jan. 16, 1996, abandoned.

[51] Int. Cl.[6] ..... A45D 34/04

[52] U.S. Cl. ..... 401/214; 401/213

[58] Field of Search ..... 401/213, 214, 401/216

[56] References Cited

U.S. PATENT DOCUMENTS

| | | | |
|---|---|---|---|
| 600,299 | 3/1898 | Werner | 401/214 |
| 2,613,382 | 10/1952 | Patterson | 401/214 |
| 2,706,474 | 4/1955 | Ackerman | 401/216 |
| 2,974,350 | 3/1961 | Schwartzman . | |
| 3,137,886 | 6/1964 | DeGroft | 401/213 |
| 3,169,267 | 2/1965 | Luedtke . | |
| 3,203,026 | 8/1965 | Schwartzman . | |
| 3,264,676 | 8/1966 | Schwartzman . | |
| 3,481,678 | 12/1969 | Schwartzman . | |
| 3,523,628 | 8/1970 | Colvin et al. | 401/213 X |
| 3,661,468 | 5/1972 | Schwartzman . | |
| 4,342,522 | 8/1982 | Mackles | 401/214 |
| 4,555,194 | 11/1985 | Hammond . | |
| 4,588,320 | 5/1986 | Weinstein et al. | 401/213 |
| 4,723,860 | 2/1988 | Giblin et al. | 401/214 X |
| 4,792,252 | 12/1988 | Kramer et al. . | |

FOREIGN PATENT DOCUMENTS

| | | | |
|---|---|---|---|
| 722842 | 12/1965 | Canada | 401/214 |
| WO92/21448 | 12/1992 | European Pat. Off. . | |
| 1492050 | 7/1967 | France . | |
| 2724099 | 3/1978 | Germany | 401/213 |
| 270136 | 11/1950 | Switzerland | 401/213 |
| 1166033 | 10/1969 | United Kingdom | 401/213 |

*Primary Examiner*—Steven A. Bratlie
*Attorney, Agent, or Firm*—Cohen, Potani, Lieberman & Pavane

[57] ABSTRACT

A self-adjustable roll-on liquid applicator having enhanced sealing features for containing and dispensing high volatility, low viscosity liquids. The applicator housing defines a discharge opening at its distal end for dispensing of contained liquid therefrom and a liquid-applying ball partially disposed in the housing distal end. An annular valve arrangement is disposed between the distal and proximal ends of the housing, thereby partitioning the housing into a ball retaining chamber and a valve-plug retaining chamber. A valve plug is movable into and out of abutment with an annular projection for regulating liquid flow between the ball retaining and valve-plug retaining chambers. The applicator also includes a spring in axial compressive engagement with the valve plug and ball for normally urging the ball into sealing abutment with a lip portion of the housing.

8 Claims, 4 Drawing Sheets

NARROW LINE APPLICATOR

RELATED U.S. APPLICATION DATA

This is a continuation of application Ser. No. 08/586,992, filed Jan. 16, 1996 now abandoned.

BACKGROUND OF THE INVENTION

1. Field of the Invention

The present invention relates to narrow line liquid applicators and, in particular, to a self-adjustable roll-on liquid applicator having enhanced sealing features for containing and dispensing low viscosity and/or high volatility liquid products.

2. Description of the Prior Art

Numerous approaches have been devised for dispensing low viscosity and/or high volatility liquids such, for example, as adhesives and perfumes onto a work surface in controlled amounts. For example, a commonly employed method makes use of a nonadjustable applicator with a tapered end. A user is typically instructed to insert a pin through the tip of the tapered end forming a small, fixed opening for passing of liquid therethrough. Such an applicator does not provide any seal for preventing leakage or evaporation of volatile liquid products stored or contained within the applicator but instead relies on the closure of a cap that is tightly engageable over the dispensing opening.

U.S. Pat. No. 3,379,490 to Schwartzman discloses an applicator for adjustably discharging lines, dots or dashes of liquid onto a work surface. The Schwartzman applicator comprises a housing having an opening at its distal end for discharging a viscous liquid and a liquid-applying ball substantially received within the housing and which is rotatively and resiliently urged into the aperture by the spring. An annular seal is formed by the compression of the outer surface of the ball against the edge of the discharge opening. Liquid is dispensed by moving the ball along a predetermined path on a work surface while pressing the ball inwardly a measured amount. However, the seal formed by the ball and the edge of the discharge opening does not adequately seal against leakage of vapors of a highly volatile liquid.

Colvin et al. (U.S. Pat. No. 3,523,628) discloses a roll-on applicator for containing and dispensing cyanoacrylate. As taught, the liquid-applying ball and the housing wall defining the dispensing surfaces of the container are formed of a thermoplastic polymeric material having a surface free-energy level which does not exceed 30 dynes/cm for preventing polymerization of the adhesive at the dispensing surfaces. Colvin et al. teaches that air-contaminated polymerized cyanoacrylate, if inadvertently returned to the container, destablizes the stored and yet-to-be dispensed cyanoacrylate and thus reduces its shelf-life. According to Colvin et al., the polymeric material may be employed at the dispensing surfaces of a typical roll-on applicator, such as the dispensing opening lip and the liquid-applying ball. Colvin et al. thus discloses an ordinary roll-on applicator which does not visibly incorporate any enhanced sealing features.

German Publication 27 24 099 discloses a roll-on applicator and a cap threadedly engaged therewith for urging the liquid-applying ball to form a first and second seals with the lip of a dispensing opening and an annular projection of the applicator housing respectively. The German publication, however, does not teach a roll-on applicator having enhanced sealing features that are also self-actuated for sealing against leakage of volatile compounds.

Weinstein (U.S. Pat. No. 4,588,320) also discloses a roll-on applicator and cap arrangement similar to that of the aforementioned German publication. The cap has a depending skirt which presses the lip at the dispensing opening against the liquid-applying ball so as to enhance the sealing engagement thereof. Weinstein also fails to teach a roll-on applicator having self-actuated seals for further preventing escape of highly volatile compounds.

The prior art thus fail to teach a roll-on applicator which includes self-actuated enhanced sealing features for preventing leakage of highly volatile liquids stored or contained in the applicator during periods of non-use. Nor does the art teach or suggest an annular valve arrangement for a roll-on applicator and which is operatively engageable by either the liquid-applying ball or a valve plug.

OBJECTS AND SUMMARY OF THE INVENTION

Accordingly, an object of the present invention is to provide a roll-on liquid applicator for containing and dispensing a low viscosity, highly volatile liquid.

Another object of the invention is to provide a roll-on liquid applicator with improved sealing features to prevent escape of volatile compounds from the applicator during periods of non-use.

Still another object of the invention is to provide a roll-on applicator with an annular valve that is sealingly engageable with a liquid-applying ball or a spring-mounted valve plug for enhancing the sealing capability of the applicator.

In accordance with an embodiment, the inventive roll-on liquid applicator for dispensingly applying a low viscosity liquid to a work surface includes an elongated housing having a distal dispensing end, a proximal end, a sidewall extending between the distal and proximal ends and defining a housing interior, and a radially-inwardly directed lip portion at the distal end defining a first valve seat and an applicator dispensing opening bounded by the first valve seat. The applicator also includes an annular valve projecting radially-inward from the housing sidewall and defining a second valve seat and a third valve seat, the second valve seat being disposed more closely proximate the housing distal end than the third valve seat. The annular valve partitions the housing interior into a first chamber at the housing proximal end for storing liquid for dispensed application to a work surface and a second chamber at the housing distal end, the annular valve bounding a valve opening through which liquid is flowable between the first and second chambers. The applicator further includes a valve member having a proximal end disposed in the first chamber, a distal end, and an engagement surface between the valve member distal and proximal ends. The valve member is disposed in the housing interior for movement between a first position in which the valve member engagement surface liquid-sealingly abuts the third seat to close the valve opening and thereby substantially prevent liquid flow between the first and second chambers, and a second position in which the valve member is displaced along the housing elongation toward the housing proximal end to space the valve member engagement surface from the third seat. The applicator still further includes a spring in the first chamber for normally resilient urging the valve member into the first position and for providing a return urgency for resiliently returning the valve member from the second position to the first position. The applicator yet further includes a liquid-applying ball rotatively disposed in the housing distal end and captively retained against escape from the housing distal end by the lip portion, the ball having a peripheral surface for receiving stored liquid from the applicator and for applying the received liquid to a work surface through rolling contact of the ball surface with the work surface in an at least partly inverted orientation of the housing. The ball is rotatively supported on the distal end of the valve member for movement of the ball, as the ball is pressed against a work surface for dispensed application of liquid to the work surface and against the return urgency of the spring means, between (a) a first position in which the ball surface liquid-sealingly abuts the first valve seat and the valve member is disposed in the first position of the valve member so as to substantially prevent liquid flow between the first and second chambers and from the second chamber through and beyond the dispensing opening, (b) a second position in which the ball is displaced from the first position of the ball toward the housing proximal end to space the ball surface from the first valve seat and thereby permit transfer of liquid from the ball surface onto a work surface through the dispensing opening, and to displace the valve member from the first toward the second position of the valve member to thereby space the valve member engagement surface from the third valve seat and open the valve opening to permit liquid flow from the first chamber to the second chamber, and (c) a third position in which the ball is displaced from the second position of the ball toward the housing proximal end so that the ball surface liquid-sealingly contacts the second valve seat to close the valve opening and thereby prevent liquid flow between the first and second chambers, the ball surface in the third position of the ball being spaced from the first valve seat so as to permit transfer of liquid from the ball surface onto a work surface through the dispensing opening.

In accordance with another embodiment, the annular valve comprises an annular projection that is shaped as a boss, having a first contact part forming the second valve seat and a second contact part forming the third valve seat. The first contact part comprises a first corner section of the boss, and the second contact part comprises a second corner section of the boss adjacent the first corner section.

In accordance with still another embodiment, the valve member engagement surface comprises a side wall radially-outwardly tapered from the distal to the proximal end of the valve member. The housing further comprises a bottom wall at the proximal end of the housing and the spring is a helical spring disposed spanningly between the valve member and the bottom wall. The valve member may be unitarily formed as a part of the helical spring.

In accordance with yet another embodiment, the applicator includes a cap for fitted releasable engagement over and about the distal end of the applicator housing to cover the applicator during periods of nonuse of the applicator, the cap being configured for displacing the ball from the first to the third position of the ball so as to close the valve opening against liquid flow between the first and second chambers with the cap engaged over and about the applicator housing distal end, and for radially-inwardly displacing the housing sidewall at the distal end of the housing into liquid-sealing abutment with the ball surface with the cap engaged over and about the applicator housing distal end.

The adjustable liquid applicator, according to a feature of the present invention, comprises a housing that includes a lip portion at a distal end thereof through which a discharge opening for dispensing liquids from the applicator is provided. A liquid-applying ball or ball body is substantially received within the housing. A spring member is secured at one end with the housing and at its other end to a seat which engages the ball to resiliently urge the ball into the discharge opening so that only a spherical portion of the ball extends through the discharge opening, thereby sealing the space between the ball and the lip portion. The housing further includes an annular flexible projection extending inwardly from an inner surface of the lip portion and proximate a distal end of the housing for further sealing the annular space between the lip portion and the ball.

According to another feature of the present invention, the annular sealing projection has a cross-section that is generally triangularly shaped or has tapered edges. This geometric configuration offers variable flexibility from the tip of the projection to the base thereof so as to facilitate sealing engagement with the outer surface of the ball, and is particularly advantageous since applicators typically exhibit a range of dimensional variations or tolerances as a result of the manufacturing process. The sealing projection is preferably disposed at some distance from the edge of the lip portion so that only a predetermined flexible part of the projection engages the surface of the ball.

According to one aspect of the present invention, the spring member of the liquid applicator is readily interchangeable with other springs having a different stiffness so that a suitable spring member may be selected for each of the various types of liquids. While the spring member is preferably detachably connected to the housing, it may alternatively be secured to the housing at a bottom surface thereof.

According to another aspect of the invention, the applicator may include a cap or cover. The cap includes annular extensions that depress the annular sealing projection on the applicator lip portion so as to enhance its sealing engagement with the sealing projection.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
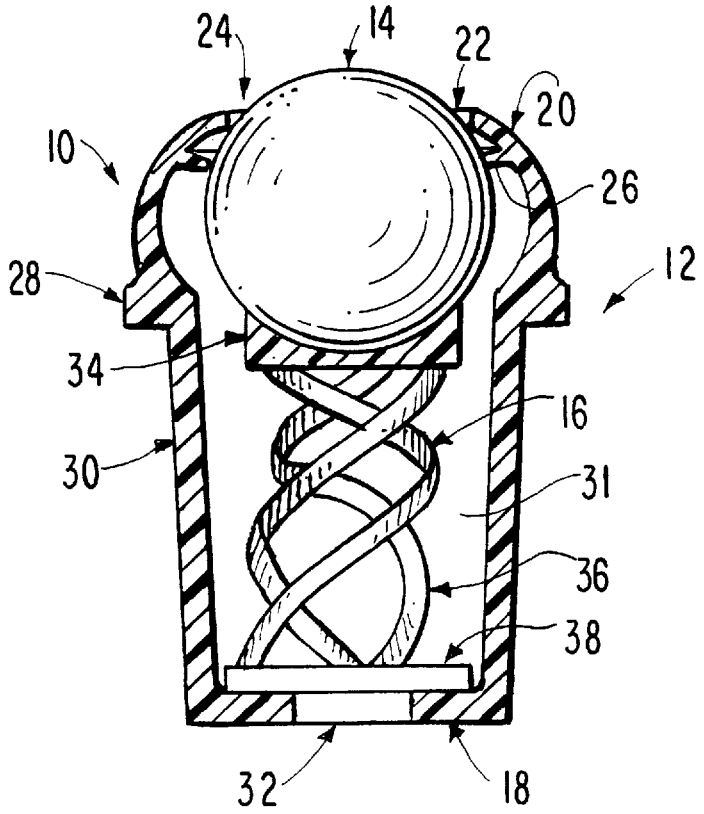
FIG. 1 is a longitudinal sectional view of a liquid applicator of a preferred embodiment according to the present invention.

Shown in FIG. 1 is a first preferred embodiment of a liquid applicator 10 constructed in accordance with the present invention. The applicator 10 comprises a housing 12 having a discharge opening 24, a liquid-applying ball or spherical body 14 having a diameter larger than the diameter of opening 24. The ball 14 is disposed partially within the housing 12 and partially protruding outwardly therefrom through the discharge opening 24. A spring member 16 is preferably detachably secured within the housing 12 at one end of the spring 16 and is disposed in axially displaceable relation with the ball 14 at its other or opposite end.

Housing 12 is preferably of unitary or integral construction formed, for example, through injection molding using a plastic such as nylon, polypropylene or other suitable material. The housing includes a lip portion 20 at its distal end, a body portion 30 and a bottom surface or rim 18 at its proximal end. The lip portion 20 and body portion 30 boundingly define an internal chamber 31. Lip portion 20 includes an edge 22 that defines the applicator discharge or dispensing opening 24, which opening 24 may be generally circular and in any event conforms to the shape of the ball 14. The edge 22 may be tapered so that it is somewhat flexible for purposes of forming a sealing engagement with another surface namely the ball 14. Ball 14 is resiliently urged by spring member 16 into the discharge opening 24 such that a spherical portion of the ball 14 extends therethrough to form a liquid seal with the edge 22. Advantageously, the spring member 16, which may be supported at one end by its bottom surface or rim 18, imparts an upward force to the ball 14, preferably through a concavely configured seat 34, to induce a compressive region around the edge 22 of lip portion 20. Substantial sealing of the applicator dispensing opening 24 is thus achieved between the surface of ball 14 and the lip portion 20. The ball 14, seat 34, spring 16 and base 38 may also be formed of plastic such as nylon, polypropylene and other suitable materials. The seal formed at the opening 24 is generally effective for high-viscosity liquids such, for example, as glue and paste since the relatively high surface tension of the liquid prevents it from unintendedly exiting through small gaps or holes that may exist at the interface formed by the outer surface of ball 14 and the edge 22 of opening 24. Based on this observation, a person of ordinary skill faced with the problem of using low-viscosity liquids in this applicator, is most likely motivated to vary the surface compliance qualities of the ball 14 and lip portion 20 so as to minimize the number and size of gaps formed therebetween and thereby seemingly increase the sealing effectiveness at the interface region. The ordinary artisan may also be motivated to vary the thickness of lip portion 20 and/or the stiffness of spring member 16 so as to increase the compressive force imparted to the interface. Such modifications, however, are generally not adequate for retaining low viscosity liquids, particularly those of high volatility.

In accordance with the invention, the difficult problem presented by low-viscosity liquid is effectively solved by providing an annular projection 26 disposed at an inner surface of lip portion 20 at a preselected distance or spacing away from the applicator dispensing or discharge opening 24, the projection 26 extending inwardly from the inner surface toward the inner chamber and shaped so as to form a secured seal with the surface of ball 14. The length of the projection 26 may be determined in view of various factors including, but not limited to, the size of ball 14, the distance between the inner surface of lip portion 20 and the outer surface of ball 14, and the stiffness/flexibility of projection 26. Preferably, projection 26 is flexible and it is most preferably sufficiently flexible as to be manually deformable.

The cross-section of projection 26 preferably has tapered edges or, alternatively, may be generally triangular and though it may, for example, also be circular or rectangular. A triangularly shaped-projection advantageously provides a highly flexible and variable seal around the ball 14 for effective sealing against low viscosity fluids. Furthermore, a triangular projection may permit a relatively wide range of dimensional variations or tolerances in the manufacturing process without impairing the sealing effectiveness of the resulting projection 26. For cost considerations, the projection 26 is preferably formed as an integral portion of the unitarily or integrally constructed housing 12, a configuration that can be readily realized using a manufacturing process such, for example, as plastic molding.

Figure 2:
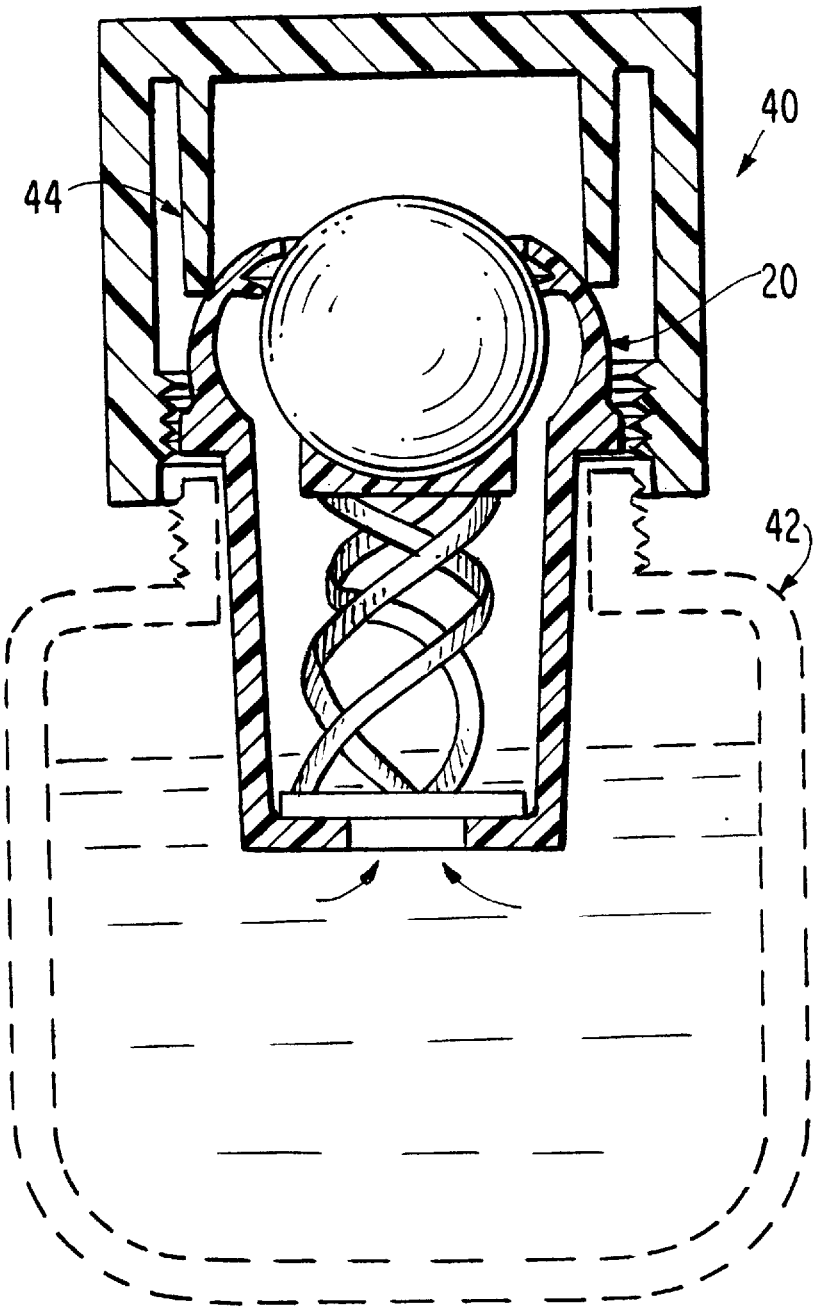
FIG. 2 is a sectional view of the liquid applicator of FIG. 1 shown in cooperative relation with a mating cap and liquid storage bottle.

With continued reference to FIGS. 1 and 2, housing 12 has a flange portion 28 located at the junction between lip portion 20 and body portion 30. The flange portion 28 and/or body portion 30 comprises engagement surfaces for detachably securing the housing 12 to a liquid reservoir such, for example, as a bottle 42. Although not shown in the figures, body portion 30 may further include male threads for locking engagement with female threads on corresponding surfaces of the bottle 42. The bottom surface or rim 18 of housing 12 may define an inlet or bore therethrough so that the housing 12 is in fluid communication with the bottle 42. Alternatively, or additionally, an inlet/outlet may be defined on any other part of the housing 12 such, for example, as a side wall of body portion 30.

As shown in FIG. 1, spring member 16 may be unitarily constructed of plastic and include the seat portion 34, a spring portion 36, and a base portion 38 that is preferably annular so that the central opening registers with an inlet 32 at the bottom of the housing to permit a substantially unobstructed flow of liquid from bottle 42 to ball 14. The seat portion 34 provides a slideable surface on which the ball 14 may captively and supportedly rotate and that is preferably concave so as to prevent disengagement of the ball 14 therefrom. The spring portion 36 may advantageously comprise multiple strands of helical coils, although a single coil of any commonly known or readily realizable configuration is also contemplated. The base portion 38 provides a surface for supported engagement with the bottom 18 of the housing 12. Although not shown in the drawing, seat portion 34 and/or base portion 38 may be constructed as a ring or donut structure from which strands of spring coils may attachedly depend. Moreover, since spring member 16 may be formed as a separate subassembly, it will be appreciated that a spring member having a predetermined stiffness value may be selected for the applicator 10, thus allowing one to suitably tailor each applicator for liquids of a different viscosity. Of course, it is contemplated that spring member 16 may alternatively be an integrally formed portion unitary with housing 12.

The ball 14 is preferably formed of a plastic material such, for example, as nylon that is readily wettable by the low-viscosity liquid so as to facilitate the transfer of the liquid onto a work surface. The outer surface of ball 14 is preferably substantially smooth so that it forms a good seal with the discharge opening edge 22 and the annular sealing projection 26 of housing 12. Without significantly compromising its sealing capacity, the surface texture of ball 14 may be varied so as to increase its wettability and thereby allow a user-controlled dispensing of a greater amount of liquid or a liquid of higher viscosity onto a work surface.

Referring now to FIG. 2, the applicator 10 of FIG. 1 is shown disposed in a cooperative operative relation with a cap 40 and a liquid-storing container or bottle 42. In this embodiment, the cap 40 may be unitarily constructed and includes a downwardly projecting annular extension 44 so that when cap 40 engages the corresponding locking surfaces of container 42, the annular extension 44 imparts radial compressive forces to annular projection 26. These radial compressive forces enhance the compression of the aforementioned sealing regions, thus improving the quality of the resulting seal between the ball 14 and lip portion 20.

In operation, a user initially inverts bottle 42 so that the liquid contained in the bottle flows into the housing 12 through inlet 32 formed at the bottom of the housing. The user may then apply the liquid onto a work surface by rolling ball 14 along the work surface while controllably depressing the ball into housing 12. This user-applied inwardly-directed force compresses spring member 16 and unseats ball 14 from both the opening 24 of lip portion 20 and the annular sealing projection 26, thereby allowing liquid to flow and/or be carried through the now open annular space between ball 14 and lip portion 20. The ball 14 is continually wetted by the liquid as it remains unseated and rotates in housing 12. The thickness and widthwise-extent of liquid applied to the work surface from the ball may be made proportional to the user-applied force by providing spring member 16 with a constant stiffness value.

When the user disengages ball 14 from the work surface, spring member 16 again urges the ball into opening 24 and reseals the annular space between ball 14 and lip portion 20, thereby terminating the flow or transfer of liquid from applicator 10. With the bottle 42 then restored to its upright position, the liquid contained in housing 12 may return to bottle 42 as a function of the remaining fluid level in bottle 42.

Figure 3:
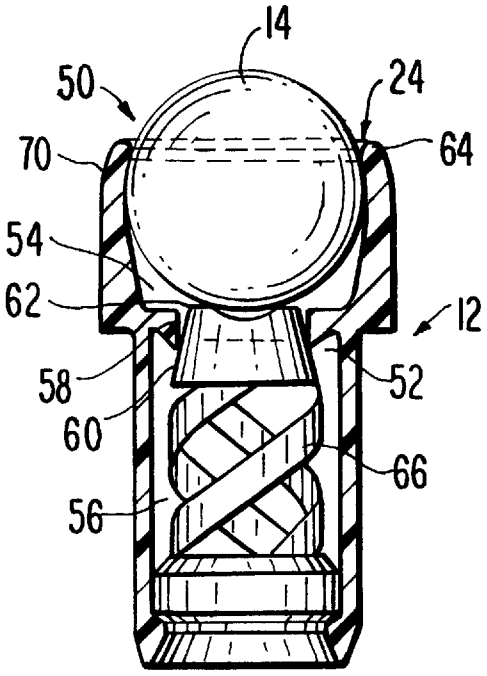
FIG. 3 is a sectional view of another preferred embodiment of a liquid applicator according to the present invention wherein the annular valve is disposed in sealing engagement with the valve plug.

Referring now to FIG. 3, there is shown another currently and, indeed, most preferred embodiment of a roll-on applicator 50 constructed in accordance with the invention and having enhanced sealing features for preventing leakage and loss of volatile low viscosity liquids during periods of non-use. A distinctive feature of this further embodiment resides in an annular valve arrangement 52 disposed between the distal and proximal ends of the housing 12 and which partitions the housing 12 into at least an upper ball retaining chamber 54 and a lower valve-plug retaining chamber 56. Valve arrangement 52 includes an annular valve 58 and a valve plug or member 60 for regulating fluid communication between the ball retaining chamber 54 and the valve-plug retaining chamber 56. Annular valve 58, preferably constructed as a unitary boss, projects radially inward from a side wall of housing 12 to define a valve opening 62 along the longitudinal extension of housing 12. Valve plug 60 has a proximal end disposed in the valve-plug chamber, a distal end disposed in the ball retaining chamber, and an engagement surface disposed between and radially-outwardly tapered from the distal to proximal end of the plug 60. Advantageously, annular valve 58 is sealingly engageable by the ball 14 or the valve-plug 60 at different positions of the ball.

The applicator 50 includes three separate valve seats for variously sealing the volatile compounds contained in the housing 12 against evaporative loss and leakage. The lip portion 64 of housing 12 defines a first valve seat bounding the applicator dispensing opening 24 and configured for liquid-sealing engagement with an upper surface portion of the ball 14. An upper and a lower surface, edge, or corner of the annular valve 58 define a second and third valve seat, respectively, whereby the second valve seat is disposed more closely proximate the housing distal end than the third valve seat. The second valve seat is configured to form a seal with a lower surface portion of ball 14, while the third valve seat is shaped to form a seal with a section of the peripheral sealing engagement surface of valve plug or member 60. The second valve seat is disposed adjacent the third valve seat. The third valve seat preferably includes a flexible extension for improved sealing engagement with valve plug 60.

Another distinctive feature of the FIG. 3 embodiment resides in the various sealing and non-sealing positions into and through which the liquid-applying ball 14 is movable and made possible by the novel arrangement of the first, second, and third valve seats. The liquid-applying ball, being inwardly displaceable along the longitudinal extension or axis of housing 12, rotatively disposed in the housing distal end and captively retained against escape from the housing distal end by lip portion 64, is movable for use into and through three distinct positions. In a first position, seen in FIG. 3, ball 14 is urged to its maximum outward extent by the urgency of spring 66 and a hemispherically upper (in the figures) portion of the ball surface is disposed in liquid-sealing engagement with the first valve seat, i.e. lip portion 64. This is the natural position of the ball during periods of uncapped nonuse of the applicator 50, or immediately prior to operative use of the applicator to selectively apply stored liquid to a work surface. As is also evident in FIG. 3, in this first position of ball 14 the sloping or angled side engagement surface of valve plug 60 engages the lower surface or edge of annular valve 58 to sealingly prevent the flow or transfer of liquid from chamber 56 to chamber 54. Together, these two seals in the first position of ball 14 effectively avoid evaporative loss and leakage of stored liquid from the applicator, even in the case of high volatility, low viscosity liquids.

As the ball is depressed from its first position into the housing 12—as by an inwardly-directed force as the ball is selectively pressed against and rolled along the work surface to transfer and deposit liquid from the applicator to the work surface under the manipulative control of the user—it reaches a second position in which the ball surface is spaced from the lip portion 64. Also in and distinguishing this second position, the ball surface at a hemispherically lower portion of ball 14 is spaced from the upper surface or edge of annular valve 58 and the angled side engagement surface of valve plug 60 is spaced from the lower surface or edge of annular valve 58. In this second position, therefore, and by virtue of these spacings, liquid stored or otherwise contained in the lower chamber 56 of the applicator is able to flow, unobstructedly subject to the predetermined spacings or clearances defined as a matter of design choice by the applicator construction, into the upper chamber 54 through valve opening 62 and then outwardly (between the ball surface and lip portion 64) from chamber 54 on and along the surface of ball 14 for rolling contact deposition onto the work surface. Because maintaining the ball in this second position would, however, result in an unacceptably unrestricted and/or uncontrolled flow of stored liquid onto the work surface—particularly where a low viscosity liquid is concerned—this second position is not intended to be the final ball position in which the continuous transfer of liquid onto the work surface takes place.

Figure 4:
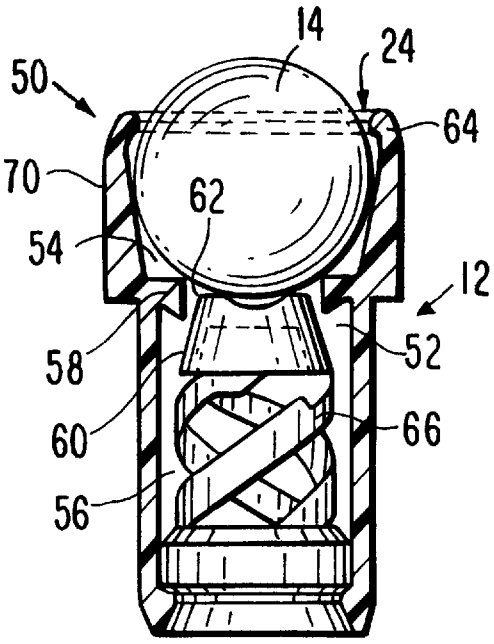
FIG. 4 is a sectional view of the embodiment of FIG. 3 wherein the lower portion of the liquid-applying ball is disposed in sealing engagement with the annular valve.

From that second position, therefore, ball 14 is further inwardly depressible to the third position depicted in FIG. 4. As there seen, the upper surface portion of the ball remains spaced from lip portion 64, thus permitting the dispensed deposit of liquid from the applicator's upper chamber 54 onto the work surface along the surface of the rotated ball. A hemispherically lower surface portion of ball 14, however, engages the upper surface or edge of annular valve 58 which prevents further inward displacement or movement of the ball while forming a substantial seal between the ball and valve 58. This seal may but need not be fully liquid-tight as it is only necessary to avoid continued uncontrolled flow of liquid from lower chamber 56 to upper chamber 54 in the inverted operative orientation of the applicator as liquid is applied, through rolling contact with ball 14, to the work surface. Indeed, it is anticipated that, depending upon the exact configuration and materials of construction utilized, some liquid may pass through this seal in the third position of ball 14 as the ball rotatively contacts the work surface. Even without any such additional flow through this seal, sufficient liquid will have passed through valve opening 62 in the second position of ball 14 to maintain a reasonable supply in upper chamber 54 for transfer, along the ball surface, onto the work surface. This arrangement accordingly assures the availability of liquid for application to the work surface while preventing an unintendedly heavy outward flow of liquid from the applicator.

Thus, it will be recognized that the movable valve plug 60 is partially received in the valve opening 62 for releasable engagement to form a liquid-seal with the third valve seat. Valve plug 60 has a generally frustoconical tapered contour (e.g. frustum) or outline such that its top portion is narrower than its bottom. The top portion of plug 60 has a cross-sectional diameter smaller than the diameter of valve opening 62 for passage through valve opening 62 and into ball-retaining or upper chamber 54 for supporting engagement with ball 14, while the bottom portion of plug 60 has a maximum diameter greater than that of opening 62 so that it remains outside of the opening 62 in lower chamber 56. In addition, the top portion of plug 60 may be specially configured to rotatively support ball 14, as by defining a concave depression at the top of plug 60. A peripheral side sealing surface of plug 60 extends from its top portion to its bottom portion and tapers, as shown, outwardly or away from the longitudinal axis of the applicator housing.

As will also be appreciated, valve plug 60 is operatively movable between sealing and non-sealing positions. In its sealing position, plug 60 is urged by the normal urgency of helical spring 66—with which it may be integrally formed—into valve opening 62 along the longitudinal axis of housing 12 so that a section of the peripheral side engagement surface of plug 60 sealingly engages the third valve seat. In its non-sealing position, the peripheral surface of plug 60 is spaced from the third valve seat to accommodate liquid flow between the ball-retaining chamber 54 and the valve-plug retaining chamber 56. Thus, spring 66 provides a return urgency for resiliently returning valve plug or member 60 from its non-sealing position to its sealing position.

Figure 5:
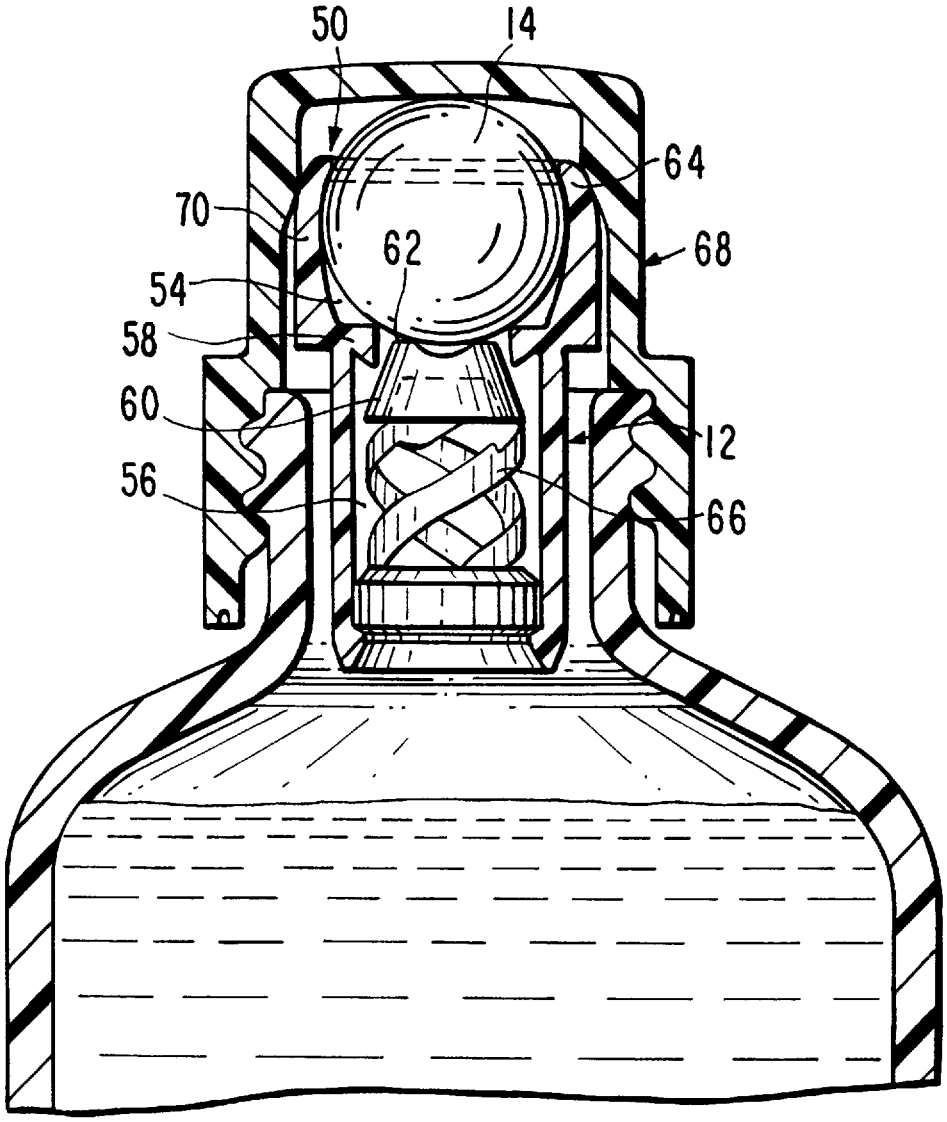
FIG. 5 is a sectional view of the liquid applicator of FIG. 3 arranged in cooperative relation with a mating cap.

Also shown in FIG. 5 is an applicator-associated cap 68 for releasable engagement over and about the liquid dispensing top end of applicator 50, as through the provision of helically-arranged mating threads defined on the inner surface of the cap and the outer face of the upper housing wall 70. Cap 68 is thereby rotatively or otherwise securable over the ball or dispensing end of the applicator to further insure against evaporative loss and leakage of liquid stored or contained within the applicator housing during extended periods of applicator nonuse. Although the highly effective applicator sealing arrangement hereinabove described is generally sufficient to prevent such liquid loss or leakage without the addition of a separate cap—even with the high volatility, low viscosity liquids which the inventive applicator is specifically constructed to dispense—such evaporative loss or leakage could nonetheless occur where the ball is unintendedly depressed to or about its second position, as through inadvertent contact with a foreign object while the applicator 50 is stored in a drawer or cabinet during extended periods of nonuse.

Accordingly, and to further enhance the sealing abilities of the applicator 50 for storage, cap 68 is configured so that with the cap fully seated or positioned on and about the dispensing end of the applicator the cap's interior surfaces or surface features apply inward pressure or forces to ball 14 and to the upper housing wall 70. Specifically, cap 68 longitudinally-inwardly depresses ball 14 to its third position in which the ball surface sealingly contacts the upper surface or edge of annular valve 58 (i.e. the second valve seat) to close the valve opening 62. In addition, and at the same time, the seated cap applies radially-inward pressure or forces to the upper housing wall 70 to deflect the walls into sealing abutment with the surface of ball 14 and thereby further prevent evaporative loss or leakage of stored liquid, as for example liquid contained within the upper chamber 54. For this purpose it is clearly preferred that the housing 12 be formed of a suitable material, and/or that the thickness and/or contouring of the upper housing wall 70 be such, as to accommodate sufficient resilient flexibility for the radially-inwardly deflection (and subsequent return urgency) provided by the cap 68 when seated about the dispensing end of the inventive applicator.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A ball-type roll-on applicator for dispensingly applying a low viscosity liquid to a work surface, comprising:

an elongated housing having a distal dispensing end, a proximal end, a sidewall extending between said distal and proximal ends and defining a housing interior, and a radially-inwardly directed lip portion at said distal end defining a first valve seat and an applicator dispensing opening bounded by said first valve seat;

an annular valve projecting radially-inward from said housing sidewall and defining a second valve seat and a third valve seat, said second valve seat being disposed more closely proximate said housing distal end than said third valve seat;

said annular valve partitioning said housing interior into a first chamber at said housing proximal end for storing liquid for dispensed application to a work surface and a second chamber at said housing distal end, and said annular valve bounding a valve opening through which liquid is flowable between said first and second chambers;

a valve member having a proximal end disposed in said first chamber, a distal end, and an engagement surface between said valve member distal and proximal ends;

said valve member being disposed in said housing interior for movement between a first position in which said valve member engagement surface liquid-sealingly abuts said third seat to close said valve opening and thereby substantially prevent liquid flow between said first and second chambers, and a second position in which said valve member is displaced along the housing elongation toward said housing proximal end to space said valve member engagement surface from said third seat;

spring means in said first chamber for normally resiliently urging said valve member into said first position and for providing a return urgency for resiliently returning said valve member from said second position to said first position; and a liquid-applying ball rotatively disposed in said housing distal end and captively retained against escape from said housing distal end by said lip portion, said ball having a peripheral surface for receiving stored liquid from the applicator and for applying the received liquid to a work surface through rolling contact of the ball surface with the work surface in an at least partly inverted orientation of the housing;

said ball being rotatively supported on the distal end of said valve member for movement of said ball, as the ball is pressed against a work surface for dispensed application of liquid to the work surface and against the return urgency of said spring means, between (a) a first position in which said ball surface liquid-sealingly abuts said first valve seat and said valve member is disposed in said first position of the valve member so as to substantially prevent liquid flow between said first and second chambers and from said second chamber through and beyond said dispensing opening, (b) a second position in which said ball is displaced from said first position of the ball toward said housing proximal end to space said ball surface from said first valve seat and thereby permit transfer of liquid from the ball surface onto a work surface through said dispensing opening, and to displace said valve member from said first toward said second position of the valve member to thereby space said valve member engagement surface from said third valve seat and open said valve opening to permit liquid flow from said first chamber to said second chamber, and (c) a third position in which said ball is displaced from said second position of the ball toward said housing proximal end so that said ball surface liquid-sealingly contacts said second valve seat to close said valve opening and thereby prevent liquid flow between said first and second chambers, said ball surface in said third position of the ball being spaced from said first valve seat so as to permit transfer of liquid from the ball surface onto a work surface through said dispensing opening.

2. A ball-type roll-on applicator in accordance with claim 1, wherein said annular valve comprises an annular projection having a first contact part forming said second valve seat and a second contact part forming said third valve seat.

3. A ball-type roll-on applicator in accordance with claim 2, wherein said annular projection comprises a unitary boss.

4. A ball-type roll-on applicator in accordance with claim 2, wherein said annular projection comprises a boss, said first contact part comprises a first corner section of said boss, and said second contact part comprises a second corner section of said boss adjacent said first corner section.

5. A ball-type roll-on applicator in accordance with claim 1, wherein said valve member engagement surface comprises a side wall radially-outwardly tapered from said distal to said proximal end of the valve member.

6. A ball-type roll-on applicator in accordance with claim 1, wherein said housing further comprises a bottom wall at the proximal end of said housing, and wherein said spring means comprises a helical spring disposed spanningly between said valve member and said bottom wall.

7. A ball-type roll-on applicator in accordance with claim 6, wherein said valve member is unitarily formed as a part of said helical spring.

8. A ball-type roll-on applicator in accordance with claim 1, further comprising a cap for fitted releasable engagement over and about the distal end of said applicator housing to cover said applicator during periods of nonuse of the applicator, said cap being configured for displacing said ball from said first to said third position of the ball so as to close said valve opening against liquid flow between said first and second chambers with said cap engaged over and about the applicator housing distal end, and for radially-inwardly displacing said housing sidewall at said distal end of the housing into liquid-sealing abutment with said ball surface with said cap engaged over and about the applicator housing distal end.

* * * * *